US011375751B2

(12) United States Patent
Moorman

(10) Patent No.: US 11,375,751 B2
(45) Date of Patent: Jul. 5, 2022

(54) HIGH VOLUME VAPORIZER

(71) Applicant: Wallace Dray Moorman, Pompano Beach, FL (US)

(72) Inventor: Wallace Dray Moorman, Pompano Beach, FL (US)

( * ) Notice: Subject to any disclaimer, the term of this patent is extended or adjusted under 35 U.S.C. 154(b) by 129 days.

(21) Appl. No.: 16/854,811

(22) Filed: Apr. 21, 2020

(65) Prior Publication Data

US 2020/0329765 A1 Oct. 22, 2020

Related U.S. Application Data

(60) Provisional application No. 62/836,713, filed on Apr. 21, 2019.

(51) Int. Cl.

| | |
|---|---|
| ***A24F 13/00*** | (2006.01) |
| ***A24F 40/40*** | (2020.01) |
| ***A24F 40/20*** | (2020.01) |
| ***A24F 40/60*** | (2020.01) |
| ***A24F 40/90*** | (2020.01) |

(52) U.S. Cl.

CPC ..... *A24F 40/40* (2020.01); *A24F 40/20* (2020.01); *A24F 40/60* (2020.01); *A24F 40/90* (2020.01)

(58) Field of Classification Search

CPC ..... A24F 47/00
USPC ..... 131/328–329
See application file for complete search history.

(56) References Cited

U.S. PATENT DOCUMENTS 10,314,341 B2 * 6/2019 Shin ..... A61M 15/06

* cited by examiner

*Primary Examiner* — Phuong K Dinh
(74) *Attorney, Agent, or Firm* — Allen F. Bennett; Bennett Intellectual Property

(57) ABSTRACT

A vaporizer having a metallic outer casing includes an internal ceramic oven insulated using cotton, a polymer material and a surrounding air pocket. A cooling chamber between the oven and the mouthpiece reduces the temperature of the vapor produced by the high temperature vaporizing oven. An LED screen on the outer casing displays information to the user. A USB port is used to recharge the internal battery.

4 Claims, 4 Drawing Sheets

HIGH VOLUME VAPORIZER

BACKGROUND OF THE INVENTION

Field of the Invention

The present invention relates to a vaporizer. More particularly, the invention relates to a vaporizer that is sturdy and durable and includes a large vaporizing chamber in a small compact device.

Description of the Related Art

In recent years the use of vaporizers has become an increasingly common. A material is heated, thereby generating a vapor that can be inhaled. The process is very similar to the process of heating a material with hot coals in a hookah. In addition, vaporizing materials, commonly known as "vaping," is a suitable method for ingesting a wide variety of chemical compositions. Vaping has become a rapidly growing and increasingly popular industry. The introduction of smaller, more compact vaporizing devices over the past several years has contributed to the rapid growth of this industry.

However, as with all new industries, there remains several aspects of the industry and vaporizing techniques that are sub optimal and could be improved. Many vaporizers are comprised mainly of low-quality plastics that easily break, bend or cease to function especially when contained within a pocket where it may be bumped by a variety of objects and subjected to other forms of stress. Many portable vaporizers, to conserve size, include a chamber that is very small and must be refilled repeatedly. Small portable vaporizer is often do not have the ability to heat a very high temperature and are not suitable for dry products.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a durable and sturdy vaporizer that is compact and portable and has an adequately sized vaporizing chamber and is capable of high temperatures to improve vaporizing of solid materials.

BRIEF SUMMARY OF THE INVENTION

Disclosed is a device that is easy to carry, comfortable to handle and is concealable by bag, hand or vape case. This dry herb convection vaporizer houses a 2200 mAh battery inside its sleek, metal chassis. The device charges in about 2.5 hours. What the device loses in lengthy charging time, it makes up for in power. The device may have about five different temperature settings. An extra wide chamber accommodates a large volume of dry products.

In one embodiment, a high volume, durable vaporizer comprises an aluminum shell, a glass mouthpiece, a filter plug, an insulated ceramic oven, a vibrating motor, a battery cell, a USB port, a glass conduit providing ambient air to the insulated ceramic oven, a microcontroller, and an LED screen.

It is therefore an object of the present invention to provide a durable, portable convection vaporizer for dry materials.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE SEVERAL VIEWS OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
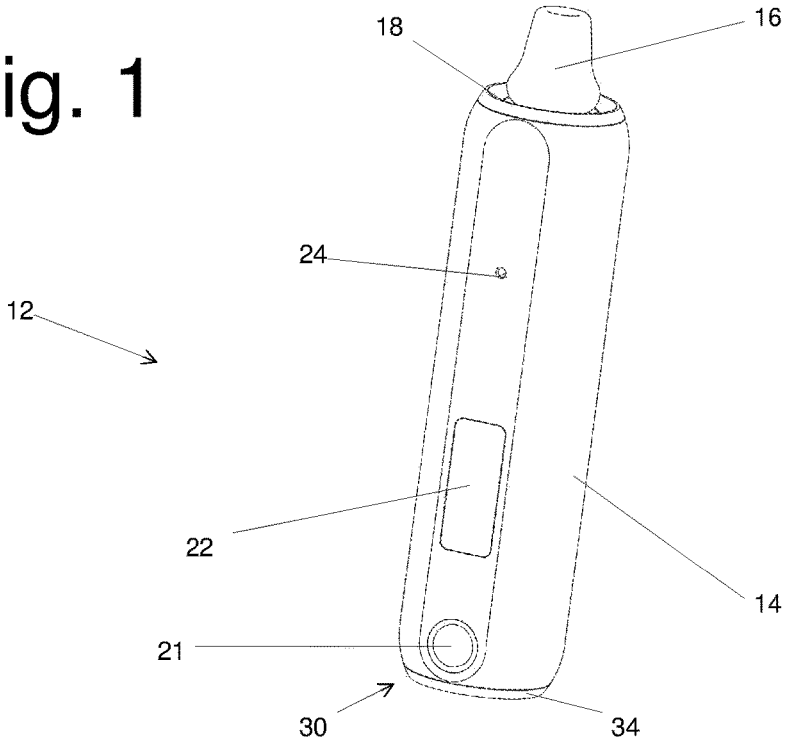
FIG. 1 is a perspective view of a vaporizer in accordance with principles of the invention.
Figure 2:
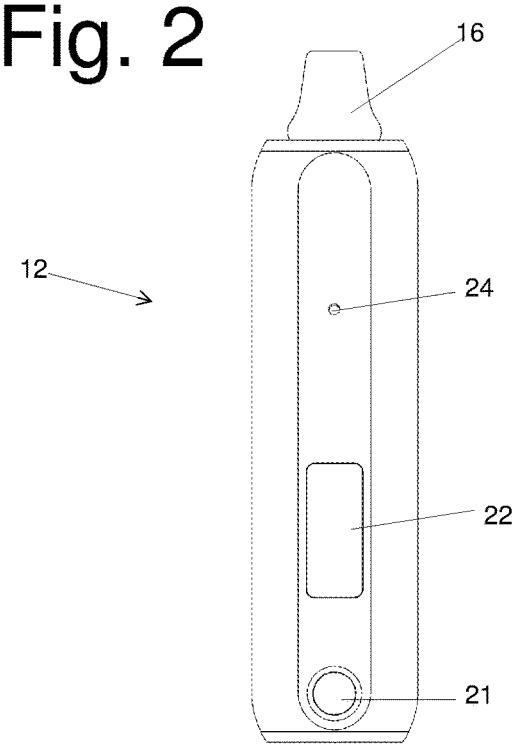
FIG. 2 is a front elevation view of a vaporizer in accordance with principles of the invention.
Figure 3:
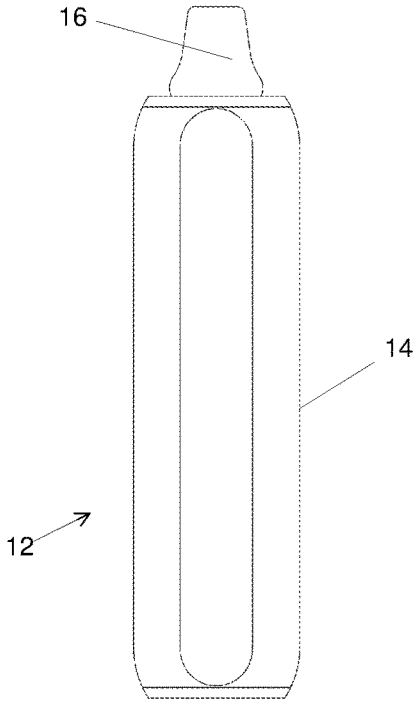
FIG. 3 is a rear elevation view of a vaporizer in accordance with principles of the invention.
Figure 4:
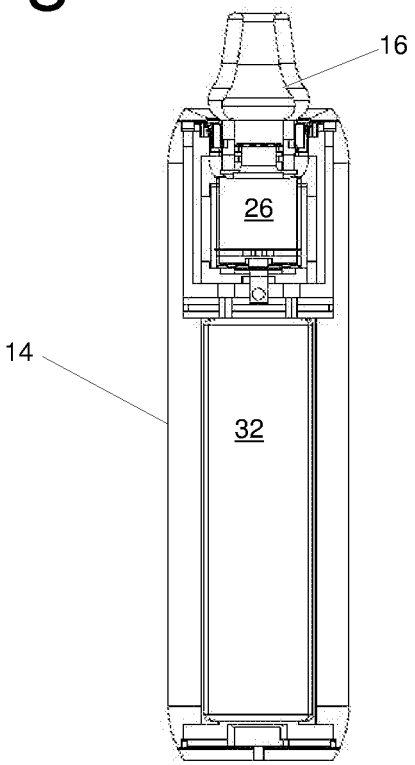
FIG. 4 is a cross-sectional view of a vaporizer in accordance with principles of the invention.
Figure 5:
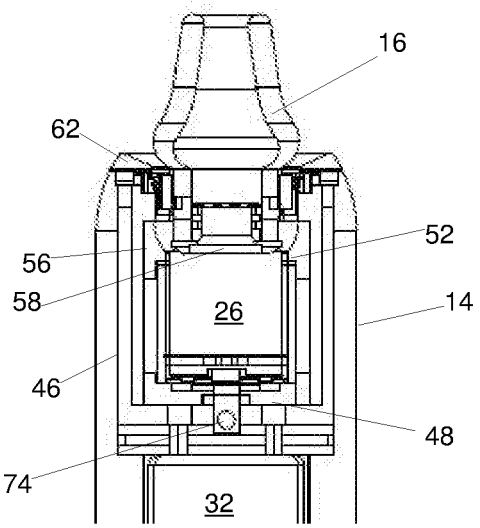
FIG. 5 is an enlarged cross-sectional view of a vaporizer in accordance with principles of the invention.
Figure 6:
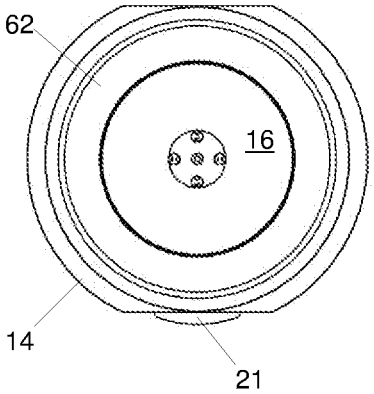
FIG. 6 is a top plan view of a vaporizer in accordance with principles of the invention.
Figure 7:
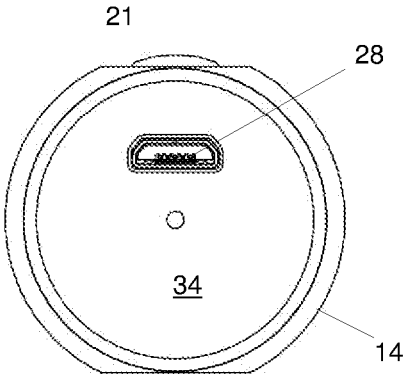
FIG. 7 is a bottom plan view of a vaporizer in accordance with principles of the invention.
Figure 8:
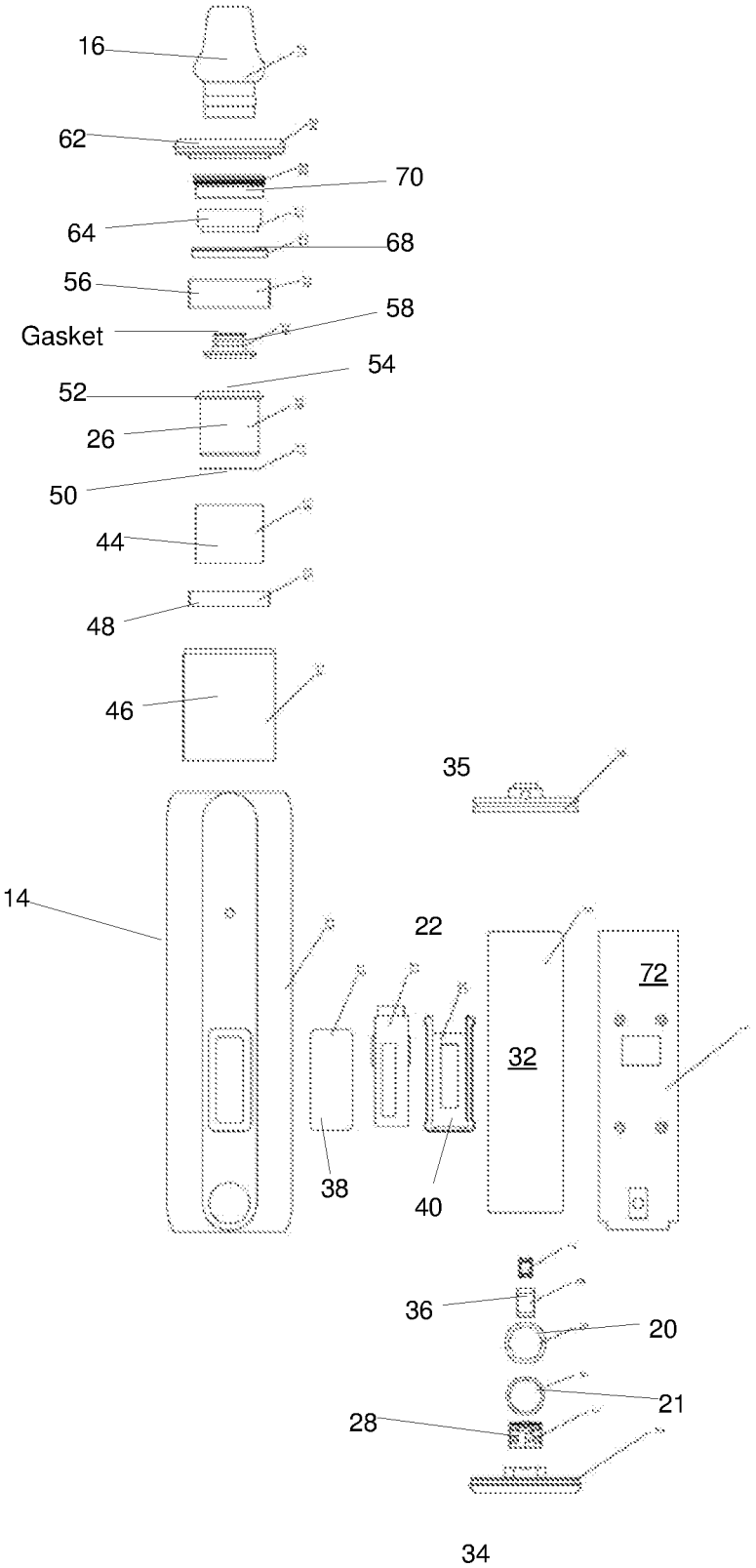
FIG. 8 is an exploded view of a vaporizer in accordance with principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

Unless otherwise indicated, all numbers expressing quantities of ingredients, dimensions reaction conditions and so forth used in the specification and claims are to be understood as being modified in all instances by the term "about". The term "a" or "an" as used herein means "at least one" unless specified otherwise. In this specification and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

Disclosed is a dry herb convection vaporizer having an insulated ceramic oven inside a shell composed of a durable material such as aluminum, titanium or the like. A small glass conduit supplies ambient air to the ceramic oven which then travels through the mouthpiece. This air supply prevents material and hailed by a user from exceeding uncomfortably high temperatures.

FIGS. 1-10 show a convection vaporizer 12 in accordance with principles of the invention. The vaporizer 12 is contained within an outer casing 14 and includes a mouthpiece 16 at its proximal end 18. The casing 14 has a distal button 21 having an indicator light 20. A small opening 24 provides access to a glass conduit which supplies air to the ceramic oven 26. A USB port 28 is located at the distal end 30 of the outer casing 14 and allows the internal battery 32 to be recharged. In this embodiment, the casing 14 is aluminum and the mouthpiece 16 is glass. These components may optionally be formed from other materials.

The distal end 30 is capped by a bottom cover 34 and sealed to the outer casing 14 by a seal ring or gasket 35. The indicator light 20 in this embodiment is an annular ring surrounding the button 21. An internal vibrating motor 36 in this embodiment is positioned proximal to the button 21. An LED screen 22 has a glass cover 38 and is held in place by a bracket 40. The ceramic oven 26 is surrounded by an insulating cuff 44, which is in turn housed within a heat insulating cover 46, a heat insulating mat 48 and a gasket 50. The gasket 50 is positioned between the insulating cuff 44 and an annular flange 52 near the proximal end 54 of the ceramic oven 26. An insulating ring 56 extends partially over the proximal end 54 of the ceramic oven 26 and houses a filter plug 58. The mouthpiece 60 extends through the top cover 62 to the filter plug 58. A cylindrical silicone ring 64 is sandwiched between an inside screw 68 and a screw ring 70. A microcontroller 72 includes the electrical circuitry for operating the vaporizer 12.

In use, a user places a dry material, or any other material to be vaporized, into the ceramic oven 26. The user then selects a temperature level by actuating the button 21 and reading the LED screen 22, and inhales through the mouthpiece. This causes air to enter the ceramic oven 26 through the opening 24 where it combines with vapor and then travels through the mouthpiece 60. A heating element 74 heats the ceramic oven 26 substantially evenly.

Figure 9:
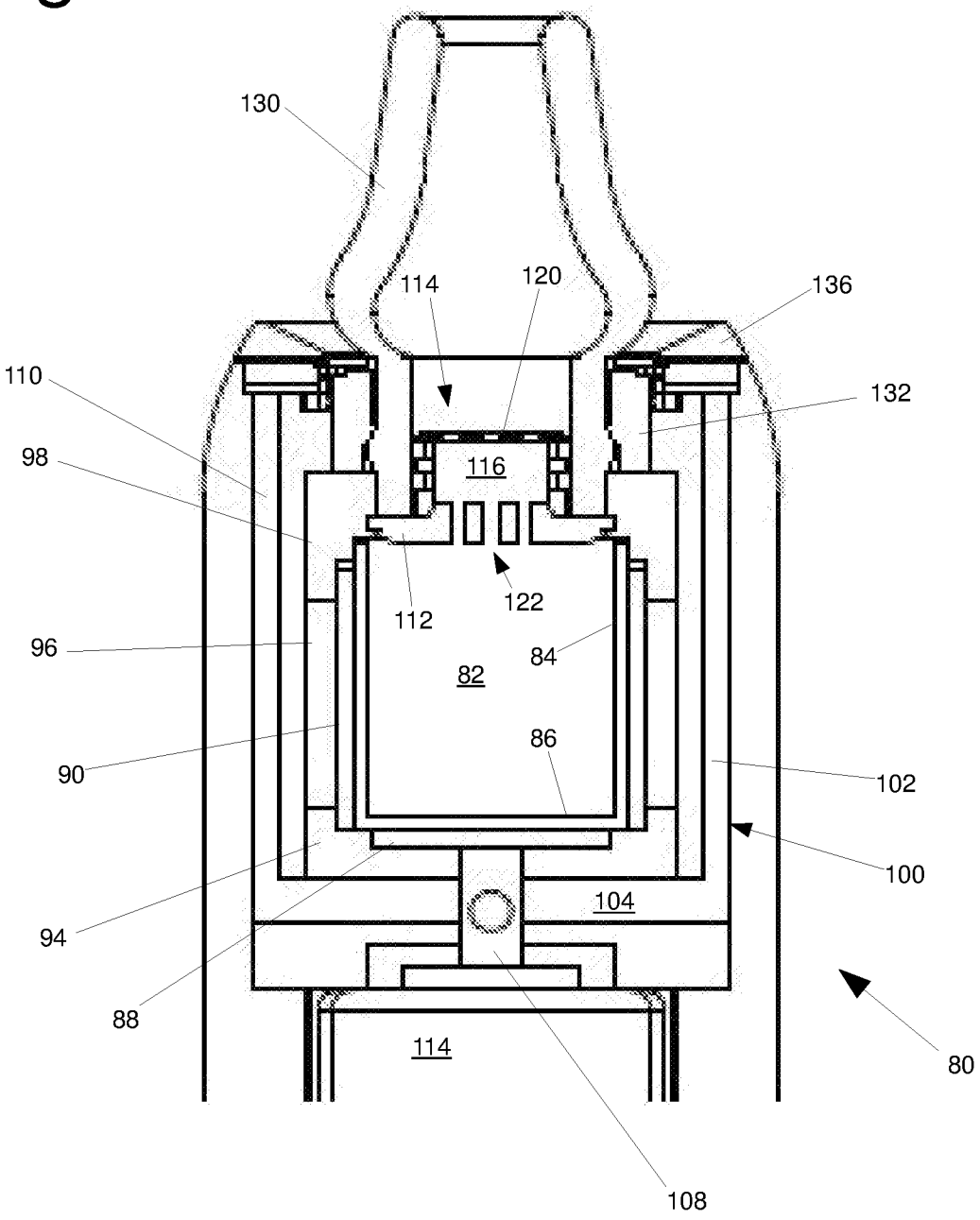
FIG. 9 is a cross-sectional view an alternative embodiment of a vaporizer in accordance with principles of the invention.

FIG. 9 shows an alternative embodiment of a high volume dry vaporizer 80 in accordance with the principles of the invention. A cylindrical ceramic oven 82 has a cylindrical sidewall 84 and a circular base 86. A heat distribution plate 88 extends across the bottom of the circular base 86. The cylindrical ceramic oven 82 is surrounded by a cylindrical cotton insulation sleeve 90. The cotton insulation sleeve 90 is completely surrounded by a Polytetrafluoroethylene (PTFE) oven casing 92 formed from three components: a PTFE base 94, a PTFE sleeve 96 and a PTFE cap 98. The oven 82 and casing 92 are inserted into a cylindrical PTFE cup 100 has a cylindrical sidewall 102 and a bottom 104.

When the cup 100 is inserted into a vaporizer 80, a heating element 108 extends through an opening in the middle of its bottom 104. The oven 82 inside the casing 92 may then be inserted into the cup 100 such that the heating element 108 aligns with an extends through an opening in the middle of the base 94 of the casing 92 and it abuts against the heat distribution plate 88. The oven 82 and casing 92 have a smaller diameter than the cylindrical sidewall 102 of the cup 100 such that a cylindrical air pocket 110 is formed between and defined by the side wall 102 and the casing 92. The cap 98 secures a bottom flange 112 of a filter plug 114 against the top of the sidewall 84 of the oven 82. A cooling chamber 116 is defined within the cylindrical filter plug 114 between an upper mesh screen 120 and a bottom plug screen 122. The bottom plug screen includes a plurality of holes larger than the openings in the mesh screen 120. A mouthpiece 130 is formed of a flexible material and secured in place by a friction fit between the filter plug 114 and the cap 98 of the casing 92. The vaporizer 106 includes a steel gasket 132 that secures both the casing 92 and the mouthpiece 130 in place when a top cover 136 is screwed onto the vaporizer 106.

During use, a dry material to be vaporized is placed within the oven 82. The heating element 108 is powered by a battery 140. The heat is distributed by the distribution plate 88 across the circular bottom 86 of the oven 82. As the material within the oven 82 vapor rises, the vapor passes through the filter plug 114, and is cooled within cooling chamber 116 before passing through the mesh 120 and through the mouthpiece 130 into a user's mouth. The bottom flange 112 and bottom plug screen 122 are made of an insulating material. As a result, the cooling chamber 116 remains cooler than the oven 182. Because a cooling chamber 116 is utilized to cool the vapor prior to introducing it to a user, the oven 82 may utilize higher temperatures, for example 150 to 200° F. or even higher, such as 200 to 250° F. to vaporize the dry material. The cooling chamber reduces the heat of the vapor such that it is still hot but not dangerously hot for a user. In addition, by using a cotton insulator, and insulating casing and an insulating air pocket, the vaporizer of the present invention allows the oven to reach very high temperatures without overheating the vaporizer itself. The elevated temperatures also allow thorough vaporizing of relatively large volumes of material within the oven 82.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated. Those skilled in the art will appreciate that the conception, upon which this disclosure is based, may readily be utilized as a basis for the designing of other structures, methods and systems for practicing the present invention. It is important, therefore, that the claims be regarded as including such equivalent constructions insofar as they do not depart from the spirit and scope of the present invention.

The invention claimed is:

1. A high volume vaporizer comprising:

an outer casing having a base at a distal end, a mouthpiece at a proximal end, and a sidewall extending between the distal end and the proximal end;

a ceramic oven having a sidewall, a base and a top having a proximal opening;

an opening in the outer casing supplying ambient air to the ceramic oven;

an insulating sleeve surrounding and flush against the sidewall of the ceramic oven;

an oven casing formed by a base, a sleeve, a cap, and a central opening through the base, wherein the oven casing surrounds and is flush against the insulating sleeve;

a heat distribution plate between the base of the oven casing and the base of the ceramic oven, wherein the heat distribution plate is flush against the base of the ceramic oven;

a heating element extending through the central opening in base of the casing and abutting against heat distribution plate;

wherein the oven casing is located inside a cup within the vaporizer;

an air pocket between the oven casing and the cup;

a filter plug extending between the mouthpiece and the proximal opening of the top of the ceramic oven; and, a cooling chamber in the filter plug extending between an upper mesh screen and bottom plug screen and providing fluid communication between the ceramic oven and the mouthpiece.

2. The high volume vaporizer of claim 1 wherein the bottom plug screen has a plurality of holes which are larger than a plurality of holes in the upper mesh screen.

3. The high volume vaporizer of claim 2 wherein the bottom plug screen is made of an insulating material.

4. The high volume vaporizer of claim 3 wherein ceramic oven is cylindrical.

* * * * *